US006392547B1

(12) United States Patent
Stewart et al.

(10) Patent No.: US 6,392,547 B1
(45) Date of Patent: May 21, 2002

(54) PROXIMITY MONITORING SYSTEM AND ASSOCIATED METHODS

(75) Inventors: Art Stewart, Melbourne Beach; David Allen Olaker, Melbourne, both of FL (US)

(73) Assignee: Microgistics, Inc., Melbourne, FL (US)

( * ) Notice: Subject to any disclaimer, the term of this patent is extended or adjusted under 35 U.S.C. 154(b) by 0 days.

(21) Appl. No.: 09/721,501

(22) Filed: Nov. 22, 2000

Related U.S. Application Data

(60) Provisional application No. 60/167,586, filed on Nov. 26, 1999, and provisional application No. 60/187,042, filed on Mar. 6, 2000.

(51) Int. Cl.[7] ..... G08B 23/00

(52) U.S. Cl. ..... 340/573.1; 340/551; 340/825.36

(58) Field of Search ..... 340/573.1, 551, 340/5.1, 825.36, 10.4, 573.2, 573.3, 573.4, 552, 553, 554, 572.2, 572.4, 572.6; 235/449, 450

(56) References Cited

U.S. PATENT DOCUMENTS 5,477,210 A 12/1995 Belcher ..... 340/573
5,627,526 A * 5/1997 Belcher et al. ..... 340/10.1
5,661,459 A * 8/1997 Belcher ..... 340/573.1
5,870,029 A * 2/1999 Otto et al. ..... 340/825.36
5,963,135 A * 10/1999 Van Marcke ..... 340/573.1
6,075,443 A * 6/2000 Schepps et al. ..... 340/573.4
6,084,513 A * 7/2000 Stoffer ..... 340/572.2

* cited by examiner

*Primary Examiner*—Daniel J. Wu
*Assistant Examiner*—Toan Pham
(74) *Attorney, Agent, or Firm*—Allen, Dyer, Doppelt, Milbrath & Gilchrist, P.A.

(57) ABSTRACT

A proximity detection system includes a magnetic field generator for generating a rotating magnetic field having a decreasing intensity over an increasing separation distance, and a magnetic field detector being relatively movable and generating a crossing indication based upon an intensity threshold in the rotating magnetic field being crossed as a threshold separation distance from the magnetic field generator is crossed. The system may also include a transmitter for transmitting a signal relating to the crossing indication from the magnetic field detector. The magnetic field generator may generate a substantially constant amplitude rotating magnetic field vector, and the magnetic field detector may comprise a plurality of orthogonal detection coils. The rotating magnetic field provides a relatively sharp cut-off threshold separation distance defining a perimeter for proximity detection.

46 Claims, 4 Drawing Sheets

PROXIMITY MONITORING SYSTEM AND ASSOCIATED METHODS

RELATED APPLICATION

This application is based upon prior filed provisional application Ser. No. 60/167,586, filed Nov. 26, 1999, and provisional application Ser. No. 60/187,042, filed Mar. 6, 2000.

FIELD OF THE INVENTION

The present invention relates to the field of location determining, and, more particularly, to proximity detection of a person or object carrying a tag.

BACKGROUND OF THE INVENTION

Proximity detection devices are used in a wide variety of applications for determining the relative nearness or separation of an object or person in relation to another object or person. Approaches of recent public interest focus on child monitoring when both the child and the guardian are within close proximity, for example less than 15 fifteen feet apart. For many other applications, this separation distance may be undesirably close.

Low frequency magnetic field generation is described in U.S. Pat. No. 5,477,210 to Belcher. The system described uses low power magnetic field generation providing sharper proximity threshold performance than high frequency approaches, with separate sequentially generated and encoded transmissions to accommodate the random orientations inherent in both portable units. The small size of the generating unit makes this approach only practical for short distances where the size of the magnetic field generation circuitry is limited. Longer range performance, as would be appropriate for child monitoring from a fixed residence necessitates 100 to 150 foot range.

Radio frequency based proximity detection systems may require the installation of a buried antenna to define a desired boundary or perimeter. Other radio frequency based proximity detection schemes based upon radiated RF signals from a central or base station may have difficulty in establishing a sharp perimeter. In addition, RF signals may be severely attenuated when passing through conventional building materials and other objects. Accordingly, the field strength may vary greatly from the desired geometry.

SUMMARY OF THE INVENTION

In view of the foregoing background, it is therefore an object of the invention to provide a proximity detection system which is readily installed, and which has a sharply defined perimeter.

These and other objects, features and advantages in accordance with the present invention are provided by a proximity detection system comprising a magnetic field generator for generating a rotating magnetic field having a decreasing intensity over an increasing separation distance, and a magnetic field detector being relatively movable and generating a crossing indication. This crossing indication is based upon an intensity threshold in the rotating magnetic field being crossed as a threshold separation distance from the magnetic field generator is crossed. The system may also include a transmitter for transmitting a signal relating to the crossing indication from the magnetic field detector.

The magnetic field generator may generate a substantially constant amplitude rotating magnetic field vector, and the magnetic field detector may comprise a plurality of orthogonal detection coils. The system may include a portable housing containing the magnetic field detector and the transmitter thereby defining an object or person tag. The magnetic field generator is typically considered as the base station, and need not necessarily be portable. The rotating magnetic field provides a relatively sharp cut-off threshold separation distance defining a perimeter for proximity detection. Of course, the proximity detection could be used to determine when the tag passes in either direction through the perimeter, although typically the system may be used to detect when the tag moves outside the perimeter.

The system may further include a receiver remote from the transmitter for receiving signals from the transmitter. The receiver may be located adjacent the magnetic field generator. The transmitter and receiver may operate at radio frequencies, for example.

In one embodiment, the transmitter may transmit a series of signals based upon an intensity of the rotating magnetic field being greater than the intensity threshold indicative that the magnetic field detector is proximate the magnetic field generator. The transmitter may stop transmitting the series of signals based upon an intensity of the rotating magnetic field being less than the threshold intensity. The system may also include an alert indicator connected to the receiver for generating an alert indication based upon failure to continue to receive the series of signals from the transmitter. Accordingly, if the transmitter fails or stops transmitting because the tag is outside the defined perimeter, an alert indication may be given.

In another embodiment, the transmitter transmits a signal based upon an intensity of the rotating magnetic field being less than the intensity threshold indicative that the magnetic field detector is no longer proximate the magnetic field generator. In this embodiment, an alert indicator may also be connected to the receiver for generating an alert indication responsive to the transmitter transmitting the signal.

The magnetic field generator may include a modulator for modulating the rotating magnetic field. The magnetic field detector may also include a demodulator which is selectively responsive to the modulated rotating magnetic field. In other words, the base station and tag can be coded by modulation so that the tag is only responsive to the correct base station and would not be responsive to a nearby base station. For example, the modulator may modulate the rotating magnetic field to have at least one of a predetermined rotation direction and a predetermined rotation speed.

The magnetic field generator may include a drive circuit and at least one pair of orthogonal coils connected thereto. Moreover, the drive circuit may have an adjustable output to set a desired separation distance corresponding to the intensity threshold. Accordingly, the threshold separation distance or perimeter can be readily set by adjusting the output of the magnetic field generator.

The drive circuit may also have a predetermined frequency and the at least one pair of coils have a predetermined size. This causes the rotating magnetic field to be generated while substantially no electric field is generated.

In accordance with another advantageous aspect of the invention, the magnetic field generator may comprise a spread spectrum modulator. The magnetic field detector will therefore include a spread spectrum demodulator. In addition, the magnetic field detector may use at least one of received signal strength and correlated signal energy from the spread spectrum modulated rotating magnetic field.

A method aspect of the invention is also for proximity detection. The method may include generating a rotating magnetic field having a decreasing intensity over an increasing separation distance from a base station, and providing a tag for an object or person that is relatively movable with respect to the base station. The tag may preferably comprise a magnetic field detector for generating a crossing indication based upon an intensity threshold in the rotating magnetic field being crossed as a threshold separation distance from the base station is crossed, and a transmitter for transmitting a signal relating to the crossing indication.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
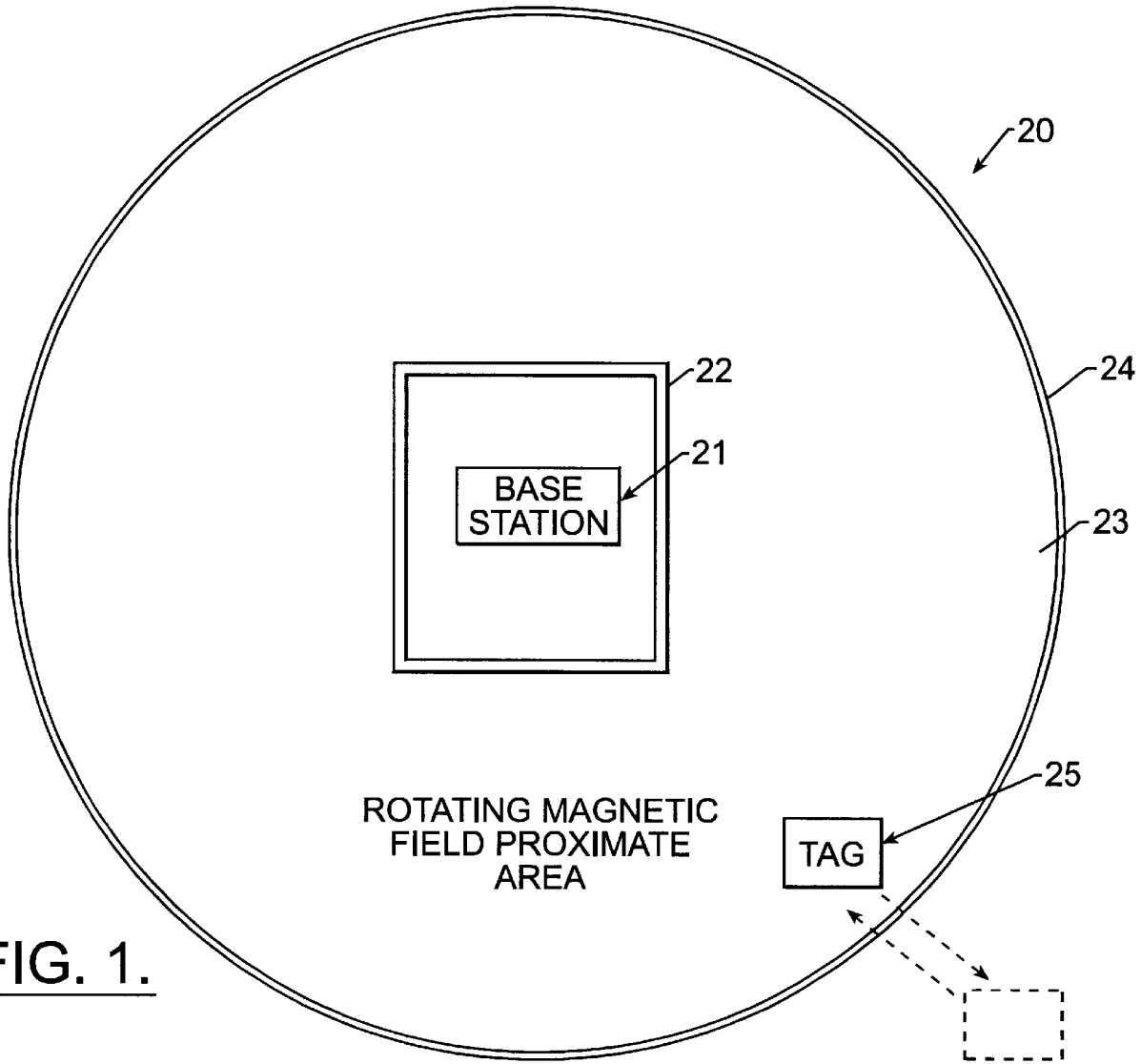
FIG. 1 is a schematic plan view of the proximity detection system in accordance with the present invention.

Referring initially to FIG. 1, the proximity detection system 20 in accordance with the invention includes a base station 21 illustratively positioned within a building structure, schematically illustrated by the rectangular walls 22. A tag 25 is carried by a person or attached to an object or asset and is generally movable relative to the base station 21. More particularly, the proximity detection system 20 may be typically used to determine when an object or person bearing the tag 25 moves outside the proximate area 23 and past the perimeter 24. For example, the object could have a high value and its movement beyond the perimeter 24 could indicate an attempted theft. Also, the tag 25 may be carried by a small child or incompetent person so that it can be determined whether the person has wondered beyond the perimeter 24 and outside of the proximate area 23. Of course, the system 20 could also be used to determine when the tag moves from outside the proximate area 23 into the proximate area as will be appreciated by those skilled in the art.

Figure 2:
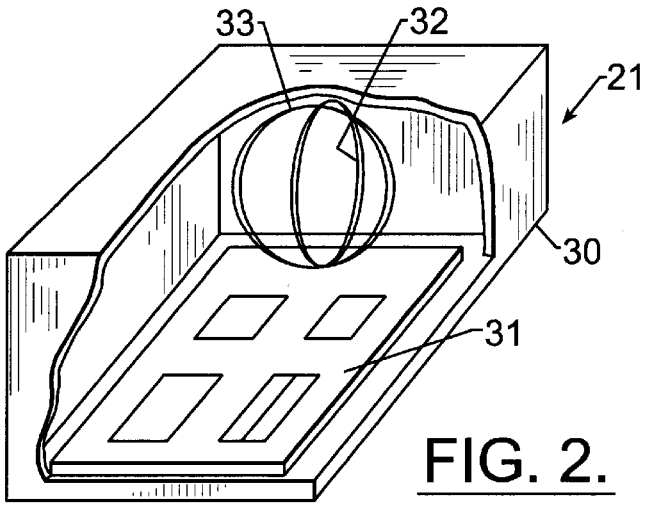
FIG. 2 is a fragmentary view of a base station as shown in FIG. 1.
Figure 3:
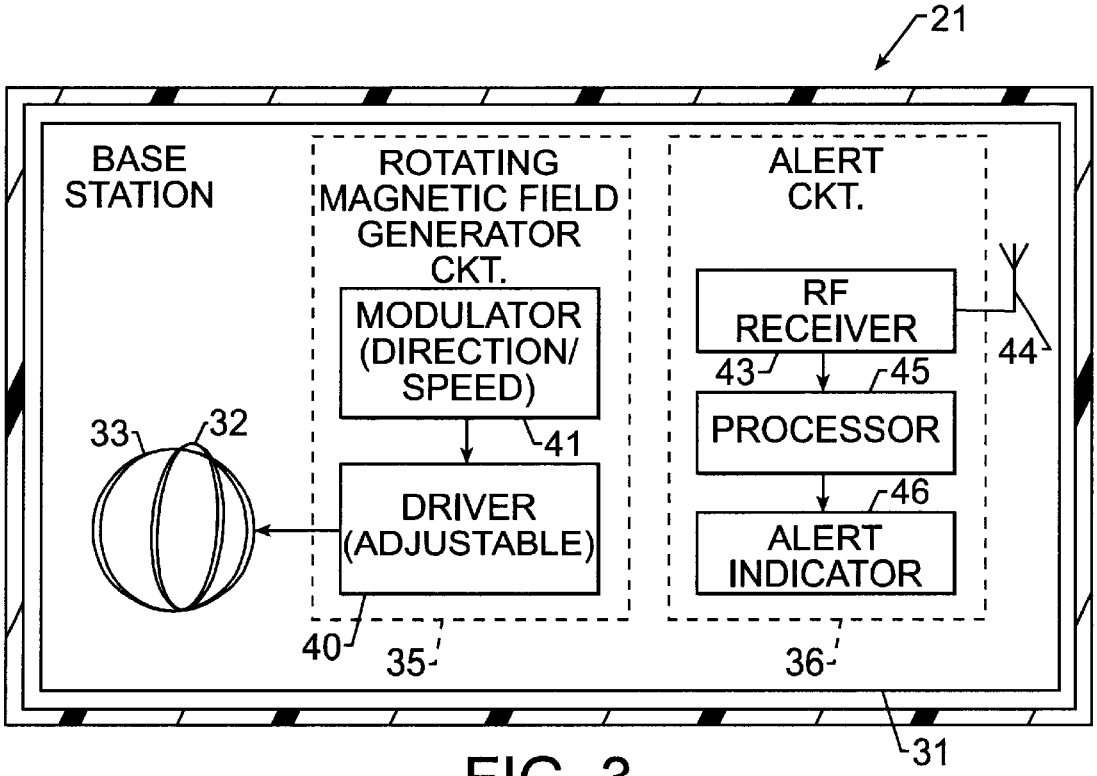
FIG. 3 is a schematic block diagram of the base station as shown in FIG. 1.

As shown in FIGS. 2 and 3, the base station 21 may include a housing 30, a printed circuit board 31 within the housing and a pair of wire coils 32, 33 carried by the housing. The base station 21 illustratively includes rotating magnetic field generating circuitry 35 on the circuit board 31. This circuitry 35 may include a driver 41 for driving the wire coils 32, 33 at a desired power level and frequency. The driver 40 may energize the coils 32, 33 at a frequency, such as in a range of about 60 KHz to 400 Khz. In addition, the size of the coils 32, 33 may be sufficiently small relative to the wavelength so that the rotating magnetic field is generated while substantially no electric field is generated. For example, the coils 32, 33 can have a diameter of less than about one foot. Other coil sizes and operating frequencies are also contemplated by the present invention.

The rotating magnetic field generator, illustratively provided by the coils 32, 33 and associated generating circuitry 35, generates a rotating magnetic field radiating outwardly to define the proximate area 23 which extends to the perimeter 24. The magnetic field penetrates common building materials and other impediments that could greatly effect an electromagnetic or RF field as will be appreciated by those skilled in the art. In addition, the magnetic field decreases in intensity relatively quickly and therefore may be used to provide a relatively sharply defined perimeter 24. The rotating magnetic field also permits the tag 25 to operate more uniformly despite variations in the orientation of the tag as will also be appreciated by those skilled in the art.

The rotating magnetic field may be circularly polarized to thereby provide a generally circular proximate area 23 and associated perimeter 24 as shown perhaps best in FIG. 1. In other embodiments, elliptical or other polarizations could also be used to define different shapes for the proximate area.

The base station 21 may also include alert circuitry 36 for providing an alert when the tag 25 crosses the perimeter 24. For example, the alert circuitry 36 may include a radio frequency (RF) receiver 43 and its associated antenna 44. In addition, a processor 45 or equivalent logic circuitry may process signals from the tag 25 as will be explained in greater detail below. The processor 45 is also illustratively connected to an alert indicator 46. The alert indicator 46 may include an audible alert indicator, visual indicator, or a combination thereof. The alert indicator 46 may also dial a telephone number, or operate a radio paging alert, such as to alert a third party, for example. Additionally, the alert indicator 46 may in the form of an interface to a security system or personal computer, for example, that can further process the alert indication.

In other embodiments of the invention, the alert circuitry 36 could be contained in a separate housing from the housing 30 of the base station 21. For example, the alert circuitry 36 could be carried in a portable housing by a care giver, relative, parent, or other person responsible for monitoring the location of the tag 25 when carried by a child or incompetent person as will be appreciated by those skilled in the art.

Figure 4:
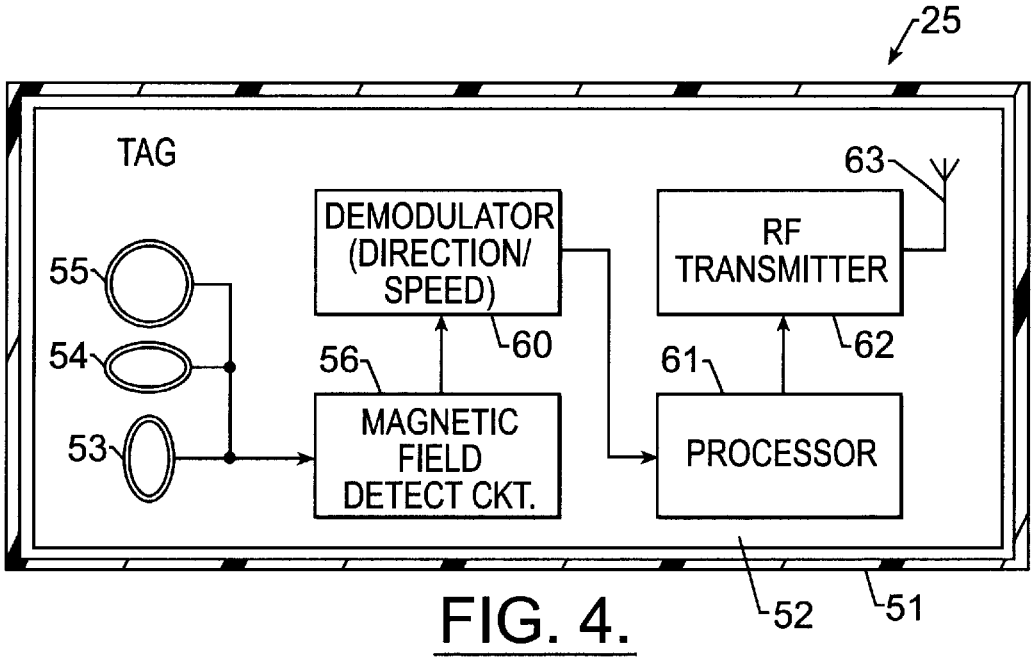
FIG. 4 is a schematic block diagram of the tag as shown in FIG. 1.

Turning now additionally to the schematic diagram of FIG. 4, the tag 25 is described in further detail. The tag 25 may include a portable housing 51 which carries a circuit board 52 and a plurality of wire coils 53–55, typically three in number as shown in the illustrated embodiment. The three orthogonally oriented coils 53–55 permit the housing 51 to be held in any orientation with respect to the rotating magnetic field produced by the base station 21 as will be appreciated by those skilled in the art. The tag 25 illustratively includes a magnetic field detection circuit 56 which, in turn, is connected to a demodulator 60 for at least one of the direction and speed of the rotating magnetic field. By modulating the rotating magnetic field from the base station 21 and demodulating the field at the tag 25, the tag and base station may be effectively coded together so that the tag is selectively responsive only to the base station to which it is assigned. Accordingly, two or more proximity detection systems 20 may be located adjacent one another and still work independently.

The coils 53–55, magnetic field detection circuit 56 and optional demodulator 60 may be considered as providing the magnetic field detector for the tag 25. The demodulator 60 may be, in turn, connected to a processor 61 or other similar logic circuitry as will be understood by those skilled in the art.

Two typical problems with conventional proximity detection systems are a lack of uniform coverage area and a sensitivity to receiver orientation. The proximity detection system 20 in accordance with the invention reduces these effects by using uniform field generation techniques in conjunction with a tag 25 adapted to make effective use of the field. The magnetic field generated may be a nearly constant amplitude rotating magnetic field vector. The tag 25 orientation sensitivity is thus reduced and the magnetic field detector of the tag further enhances this effect by using a plurality of orthogonal receive coils 53–55 to ensure capturing the largest available signal strength. The outputs of the coils 53–55 are preferably combined to create a uniform output regardless of the tag 25 orientation.

Highly precise range threshold detection may be achieved in accordance with the invention by field sensing the non-radiated magnetic field due to the static characteristics and steep attention properties as relative to a radiated RF field, for example. The proximity detection system 20 is also relatively easy to install without laying a wire as in a RF invisible fence, for example. Of course, the base station 21 could also be movable, such as with a person monitoring an object or person carrying the tag 25.

The processor 61 is illustratively connected to the RF transmitter 62 and its associated antenna 63. The processor 61 may perform a number of different functions as described herein. For example, in one embodiment, the transmitter 62 may be operated to transmit a series of RF signals based upon an intensity of the rotating magnetic field being greater than an intensity threshold indicative that the tag 25 is proximate the base station 21, that is, in the proximate area 23 or within the perimeter 24.

The transmitter 62 may be operated to stop transmitting the series of signals based upon the intensity of the rotating magnetic field being less than the threshold intensity. The alert circuit 36 of the base station 21 may generate an alert indication based upon failure to continue to receive the series of signals from the transmitter 62. In other words, the alert circuit 36 provides a time out feature if the signal from the transmitter 62 is no longer being received. Accordingly, if the transmitter 62 otherwise fails or stops transmitting because the tag 25 is outside the defined perimeter 24, an alert indication may be given to the user or third party as described above. In slightly different terms, in this embodiment an acknowledgment function is provided where if the magnetic field is detected, a signal is transmitted to acknowledge the detection.

The driver 40 of the rotating magnetic field generator circuit 35 of the base station 21 may also have an adjustable power output to set a desired separation distance corresponding to the intensity threshold. This permits the threshold separation distance or perimeter 24 to be readily set by adjusting the output of the magnetic field generator. For example, the perimeter 24 can be set outward to a radial distance of up to about 150 feet.

In another embodiment, the transmitter 62 transmits a signal based upon an intensity of the rotating magnetic field being less than the intensity threshold indicative that the magnetic field detector of the tag 25 is no longer proximate the magnetic field generator of the base station 21. In this embodiment, an alert indication may be given responsive to the transmitter 62 transmitting the signal to the receiver 43 at the base station 21.

Figure 5:
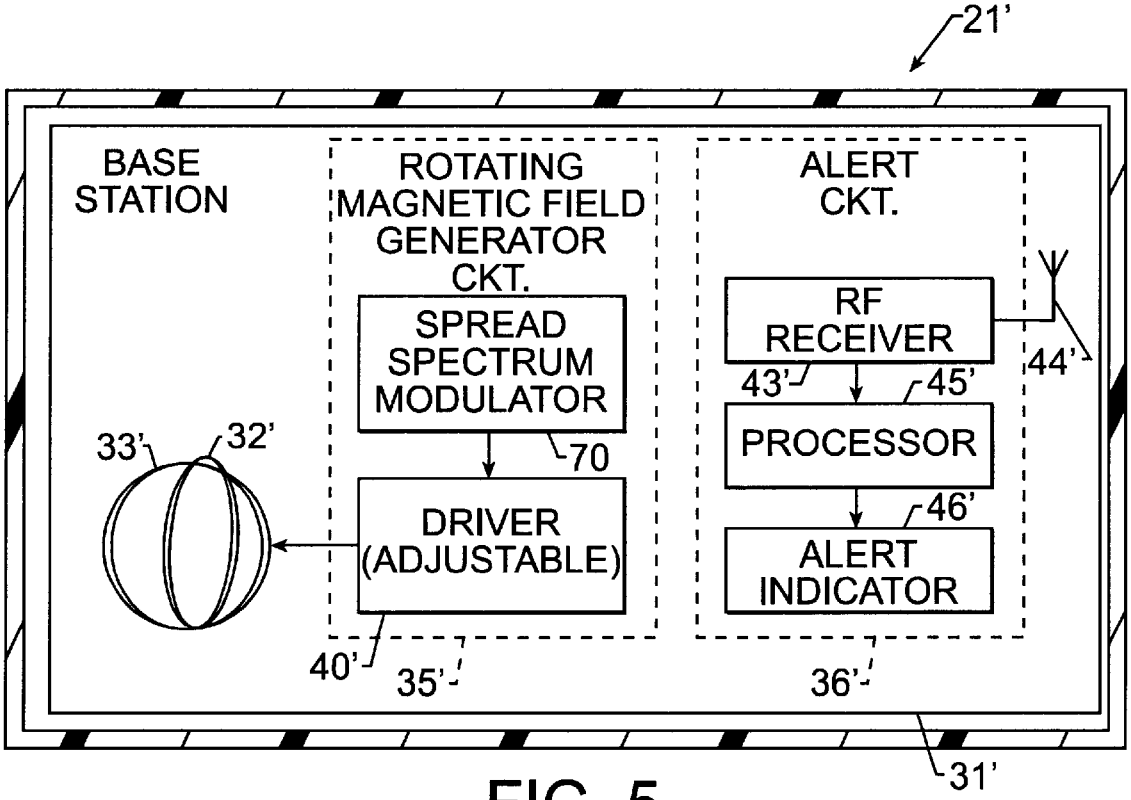
FIG. 5 is a schematic block diagram of an alternate embodiment of a base station as shown in FIG. 1.
Figure 6:
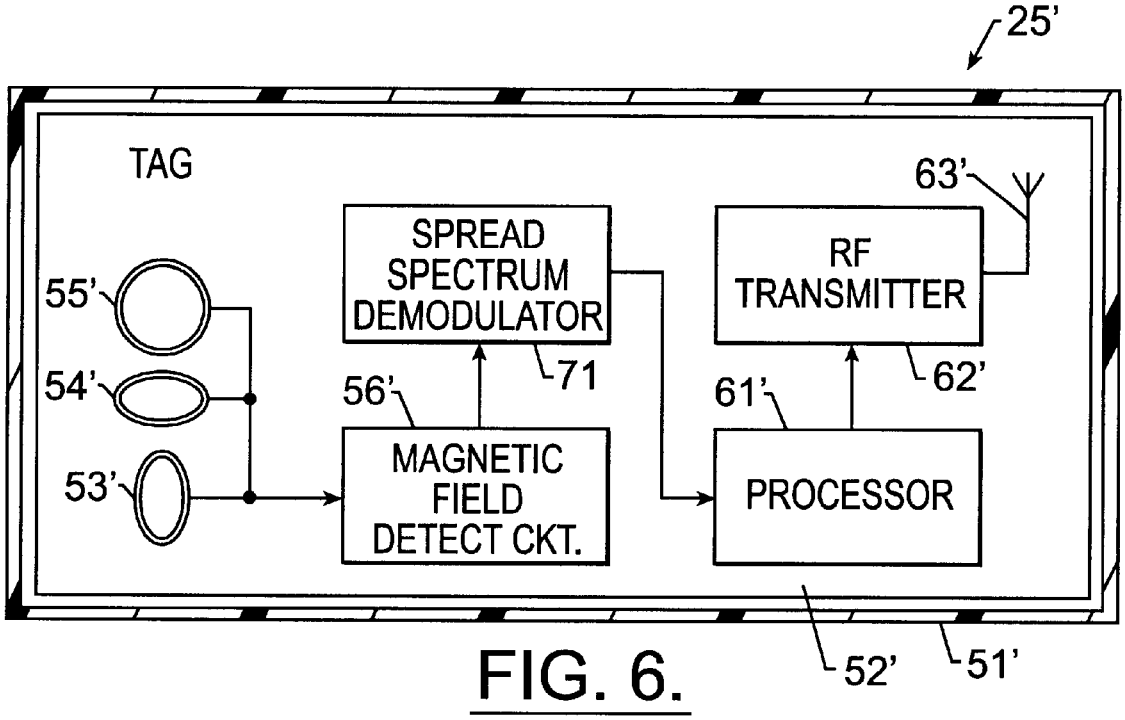
FIG. 6 is a schematic block diagram of an alternate embodiment of a tag as shown in FIG. 1.

Turning now additionally to FIGS. 5 and 6, another advantageous feature of the invention is now described. The base station 21' may include a spread spectrum modulator 70 and the tag 25' may include a spread spectrum demodulator 71. The other elements of the base station 21' and tag 25' are indicated with a prime and are similar to those elements described above and these elements need no further discussion herein. The spread spectrum modulator 70 and demodulator 71 are shown in place of the encoding modulator 41 (FIG. 3) and associated demodulator 60 (FIG. 4), however, those of skill in the art will recognize that in other embodiments, these two types of modulation/demodulation can be used in combination.

As will be readily appreciated by those skilled in the art, the spread spectrum technique may be used to improve performance against the mainly continuous wave interference sources that may be present in the environment. The waveform energy is spread across a wide bandwidth at the base station 21' and then recombined at the tag 25'. This has the effect of spreading the interference energy at the tag 25' across a wide bandwidth allowing it to be filtered out.

These embodiments of the base station 21' and tag 25' thus allow the use of a very narrow net bandwidth, which improves sensitivity with respect to thermal noise and increases range. The tag 25' can use either a time invariant matched filter or an acquisition and tracking loop technique or some combination of these techniques to recover the magnetic field waveform as will be appreciated by those skilled in the art. The magnetic field detector can use either the received signal strength, the correlated signal energy, or a combination of these to determine range.

A method aspect of the invention is also for proximity detection. The method may include generating a rotating magnetic field having a decreasing intensity over an increasing separation distance from a base station 21, 21', and providing a tag 25, 25' for an object or person that is relatively movable with respect to the base station. The tag 25, 25' may preferably comprise a magnetic field detector for generating a crossing indication based upon an intensity threshold in the rotating magnetic field being crossed as a threshold separation distance from the base station is crossed, and a transmitter 62, 62' for transmitting a signal relating to the crossing indication.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the appended claims.

That which is claimed is:

1. A proximity detection system comprising:

a magnetic field generator for generating a rotating magnetic field having a decreasing intensity over an increasing separation distance;

a magnetic field detector being relatively movable and generating a crossing indication based upon an intensity threshold in the rotating magnetic field being crossed as a threshold separation distance from said magnetic field generator is crossed; and a transmitter for transmitting a signal relating to the crossing indication from said magnetic field detector.

2. A proximity detection system according to claim 1 further comprising a receiver remote from said transmitter for receiving signals from said transmitter.

3. A proximity detection system according to claim 2 wherein said transmitter comprises a radio frequency transmitter and said receiver comprises a radio frequency receiver.

4. A proximity detection system according to claim 2 wherein said transmitter transmits a series of signals to said receiver based upon an intensity of the rotating magnetic field being greater than the intensity threshold indicative that said magnetic field detector is proximate said magnetic field generator; and wherein said transmitter stops transmitting the series of signals to said receiver based upon an intensity of the rotating magnetic field being less than the threshold intensity.

5. A proximity detection system according to claim 4 further comprising an alert indicator connected to said receiver for generating an alert indication responsive to said receiver failing to receive the series of signals from said transmitter.

6. A proximity detection system according to claim 2 wherein said transmitter transmits a signal to said receiver based upon an intensity of the rotating magnetic field being less than the intensity threshold indicative that said magnetic field detector is no longer proximate said magnetic field generator.

7. A proximity detection system according to claim 6 further comprising an alert indicator connected to said receiver for generating an alert indication responsive to said receiver receiving the signal from said transmitter.

8. A proximity detection system according to claim 1 further comprising a portable housing containing said magnetic field detector and said transmitter.

9. A proximity detection system according to claim 1 wherein said magnetic field generator comprises a modulator for modulating the rotating magnetic field; and wherein said magnetic field detector comprises a demodulator which is selectively responsive to the modulated rotating magnetic field.

10. A proximity detection system according to claim 9 wherein said modulator modulates the rotating magnetic field to have at least one of a predetermined rotation direction and a predetermined rotation speed.

11. A proximity detection system according to claim 1 wherein said magnetic field generator comprises a drive circuit and at least one pair of orthogonal coils connected thereto.

12. A proximity detection system according to claim 11 wherein said drive circuit has an adjustable output to set a desired separation distance corresponding to the intensity threshold.

13. A proximity detection circuit according to claim 11 wherein said drive circuit has a predetermined frequency and said at least one pair of orthogonal coils have a predetermined size so that the rotating magnetic field is generated while substantially no electric field is generated.

14. A proximity detection system according to claim 1 wherein said magnetic field generator comprises a spread spectrum modulator; and wherein said magnetic field detector comprises a spread spectrum demodulator.

15. A proximity detection system according to claim 14 wherein said magnetic field detector uses at least one of received signal strength and correlated signal energy from the spread spectrum modulated rotating magnetic field.

16. A proximity detection system according to claim 1 wherein said magnetic field generator generates a substantially constant amplitude rotating magnetic field vector; and wherein said magnetic field detector comprises a plurality of orthogonal detection coils.

17. A proximity detection system comprising:

a magnetic field generator for generating a modulated rotating magnetic field having a decreasing intensity over an increasing separation distance, the modulated rotating magnetic field being modulated to have at least one of a predetermined direction and predetermined speed;

a magnetic field detector being relatively movable and generating a crossing indication based upon an intensity threshold in the modulated rotating magnetic field being crossed as a threshold separation distance from said magnetic field generator is crossed; and a transmitter for transmitting a signal relating to the crossing indication from said magnetic field detector.

18. A proximity detection system according to claim 17 further comprising a receiver remote from said transmitter for receiving signals from said transmitter.

19. A proximity detection system according to claim 18 wherein said transmitter comprises a radio frequency transmitter and said receiver comprises a radio frequency receiver.

20. A proximity detection system according to claim 18 wherein said transmitter transmits a series of signals to said receiver based upon an intensity of the modulated rotating magnetic field being greater than the intensity threshold indicative that said magnetic field detector is proximate said magnetic field generator; and wherein said transmitter stops transmitting the series of signals to said receiver based upon an intensity of the rotating magnetic field being less than the threshold intensity.

21. A proximity detection system according to claim 20 further comprising an alert indicator connected to said receiver for generating an alert indication responsive to said receiver failing to receive the series of signals from said transmitter.

22. A proximity detection system according to claim 18 wherein said transmitter transmits a signal to said receiver based upon an intensity of the modulated rotating magnetic field being less than the intensity threshold indicative that said magnetic field detector is no longer proximate said magnetic field generator.

23. A proximity detection system according to claim 22 further comprising an alert indicator connected to said receiver for generating an alert indication responsive to said receiver receiving the signal from said transmitter.

24. A proximity detection system according to claim 18 further comprising a portable housing containing said magnetic field detector and said transmitter.

25. A proximity detection system according to claim 17 wherein said magnetic field generator comprises a drive circuit and at least one pair of orthogonal coils connected thereto.

26. A proximity detection system according to claim 17 wherein said magnetic field generator generates a substantially constant amplitude modulated rotating magnetic field vector; and wherein said magnetic field detector comprises a plurality of orthogonal detection coils.

27. A proximity detection system comprising:

a magnetic field generator for generating a spread spectrum modulated rotating magnetic field having a decreasing intensity over an increasing separation distance;

a magnetic field detector being relatively movable and generating a crossing indication based upon an intensity threshold in the spread spectrum modulated rotating magnetic field being crossed as a threshold separation distance from said magnetic field generator is crossed; and a transmitter for transmitting a signal relating to the crossing indication from said magnetic field detector.

28. A proximity detection system according to claim 27 wherein said magnetic field detector uses at least one of received signal strength and correlated signal energy from the spread spectrum modulated rotating magnetic field.

29. A proximity detection system according to claim 27 further comprising a receiver remote from said transmitter for receiving signals from said transmitter.

30. A proximity detection system according to claim 29 wherein said transmitter comprises a radio frequency transmitter and said receiver comprises a radio frequency receiver.

31. A proximity detection system according to claim 29 wherein said transmitter transmits a series of signals to said receiver based upon an intensity of the spread spectrum modulated rotating magnetic field being greater than the intensity threshold indicative that said magnetic field detector is proximate said magnetic field generator; and wherein said transmitter stops transmitting the series of signals to said receiver based upon an intensity of the spread spectrum rotating magnetic field being less than the threshold intensity.

32. A proximity detection system according to claim 31 further comprising an alert indicator connected to said receiver for generating an alert indication responsive to said receiver failing to receive the series of signals from said transmitter.

33. A proximity detection system according to claim 29 wherein said transmitter transmits a signal to said receiver based upon an intensity of the spread spectrum modulated rotating magnetic field being less than the intensity threshold indicative that said magnetic field detector is no longer proximate said magnetic field generator.

34. A proximity detection system according to claim 33 further comprising an alert indicator connected to said receiver for generating an alert indication responsive to said receiver receiving the signal from said transmitter.

35. A proximity detection system according to claim 27 further comprising a portable housing containing said magnetic field detector and said transmitter.

36. A proximity detection system according to claim 27 wherein said magnetic field generator comprises a drive circuit and at least one pair of orthogonal coils connected thereto.

37. A proximity detection system according to claim 27 wherein said magnetic field generator generates a substantially constant amplitude rotating magnetic field vector; and wherein said magnetic field detector comprises a plurality of orthogonal detection coils.

38. A method for proximity detection comprising:

generating a rotating magnetic field having a decreasing intensity over an increasing separation distance from a base station; and providing a tag for an object or person that is relatively movable with respect to the base station, the tag comprising a magnetic field detector for generating a crossing indication based upon an intensity threshold in the rotating magnetic field being crossed as a threshold separation distance from the base station is crossed, and a transmitter for transmitting a signal relating to the crossing indication.

39. A method according to claim 38 further comprising receiving signals from the transmitter.

40. A method according to claim 38 wherein the transmitter transmits a series of signals based upon an intensity of the rotating magnetic field being greater than the intensity threshold indicative that the tag is proximate the base station; wherein the transmitter stops transmitting the series of signals based upon an intensity of the rotating magnetic field being less than the threshold intensity; and further comprising generating an alert indication responsive to the transmitter stopping transmitting of the series of signals.

41. A method according to claim 38 wherein the transmitter transmits a signal based upon an intensity of the rotating magnetic field being less than the intensity threshold indicative that the tag is no longer proximate the base station; and further comprising generating an alert indication responsive to failing to receive the series of signals from the transmitter.

42. A method according to claim 38 further comprising modulating the rotating magnetic field; and wherein the magnetic field detector is selectively responsive to the modulated rotating magnetic field.

43. A method according to claim 42 wherein modulating the rotating magnetic field comprises modulating the rotating magnetic field to have at least one of a predetermined rotation direction and a predetermined rotation speed.

44. A method according to claim 38 further comprising setting an output of a magnetic field generator for generating the rotating magnetic field to set a desired separation distance corresponding to the intensity threshold.

45. A method according to claim 38 wherein generating the rotating magnetic field further comprises generating a spread spectrum modulated rotating magnetic field; and wherein the magnetic field detector comprises a spread spectrum demodulator.

46. A method according to claim 38 wherein generating the rotating magnetic field comprises generating a substantially constant amplitude rotating magnetic field vector; and wherein the magnetic field detector comprises a plurality of orthogonal detection coils.

* * * * *